US010197358B2

(12) United States Patent
Hebden et al.

(10) Patent No.: US 10,197,358 B2
(45) Date of Patent: Feb. 5, 2019

(54) WEAPONS SYSTEM FOREGRIP WITH INTEGRATED DEPLOYABLE COMPARTMENT FOR COMPLIANCE DEVICE

(71) Applicants: Skyler John Hebden, Oakland, MD (US); Dmitry Sergeevich Kubin, Oakland, MD (US)

(72) Inventors: Skyler John Hebden, Oakland, MD (US); Dmitry Sergeevich Kubin, Oakland, MD (US)

( * ) Notice: Subject to any disclaimer, the term of this patent is extended or adjusted under 35 U.S.C. 154(b) by 0 days.

(21) Appl. No.: 15/286,536

(22) Filed: Oct. 5, 2016

(65) Prior Publication Data

US 2017/0097208 A1 Apr. 6, 2017

Related U.S. Application Data

(60) Provisional application No. 62/237,640, filed on Oct. 6, 2015.

(51) Int. Cl.
*F41H 9/10* (2006.01)
*F41C 23/22* (2006.01)
*F41C 23/16* (2006.01)

(52) U.S. Cl.
CPC ..... *F41C 23/22* (2013.01); *F41C 23/16* (2013.01); *F41H 9/10* (2013.01)

(58) Field of Classification Search
CPC .. F41H 9/10; F41C 23/16; F41C 23/22; F41C 27/00; F41G 11/003
USPC ..... 42/72, 1.08, 71.01; 222/79, 192
See application file for complete search history.

(56) References Cited

U.S. PATENT DOCUMENTS 1,746,496 A * 2/1930 Palmgren ..... B25C 5/085 227/130
4,058,921 A * 11/1977 Mason ..... F41C 23/10 222/79
4,316,338 A * 2/1982 Mason ..... F41C 23/10 222/79
4,505,179 A * 3/1985 Nelson ..... F41C 27/06 102/504
5,405,134 A * 4/1995 Wolfram ..... F21V 33/0064 222/175
5,549,220 A * 8/1996 Whalen ..... B05B 9/0805 116/81
5,671,559 A * 9/1997 Ludaesher ..... F41B 9/00 222/79
5,787,628 A * 8/1998 Teetzel ..... F41H 9/10 222/79
5,983,548 A * 11/1999 Ludaescher ..... F41H 9/10 42/1.08
6,026,990 A * 2/2000 Brunswig ..... F21V 33/0064 222/153.13

(Continued)

*Primary Examiner* — Michael D David
(74) *Attorney, Agent, or Firm* — William F. Lang, IV; Lang Patent Law LLC

(57) ABSTRACT

A vertical foregrip for a firearm is structured to secure a nonlethal weapon or compliance device, for example, a commonly available pepper spray canister, therewithin. Some examples of the vertical foregrip may include an attachment that is structured to secure to a commonly available accessory rail such as a Picatinny rail. The vertical foregrip facilitates use of the nonlethal weapon or compliance device while the firearm is being held by the shooter, with the support hand holding the vertical foregrip and activating the compliance device.

5 Claims, 2 Drawing Sheets

(56) References Cited

U.S. PATENT DOCUMENTS 6,050,454 A * 4/2000 Ludaescher ..... F21V 33/0064 222/162
6,052,051 A * 4/2000 Whalen ..... F41H 9/10 222/1
6,196,419 B1 * 3/2001 Haney ..... B65D 83/202 222/153.03
6,499,855 B1 * 12/2002 Kukuk ..... F21V 33/0064 362/102
6,546,661 B1 * 4/2003 Staubs ..... F41H 9/10 102/367
6,658,779 B2 * 12/2003 Bauer ..... B65D 83/202 222/79
7,111,424 B1 * 9/2006 Moody ..... F41A 23/08 248/171
7,121,432 B2 * 10/2006 Kostal ..... F41H 9/10 222/192
7,524,076 B2 * 4/2009 Kukuk ..... F41C 23/10 362/109
7,568,637 B2 * 8/2009 Hornsby ..... B05B 1/3436 239/332
7,588,198 B2 * 9/2009 Hornsby ..... B05B 9/0861 222/158
7,644,839 B2 * 1/2010 McNulty, Jr. ..... F41B 9/00 222/162
7,648,083 B2 * 1/2010 Hornsby ..... B05B 1/3436 239/333
7,787,232 B2 * 8/2010 Abatemarco ..... A45B 3/04 361/232
7,810,423 B2 * 10/2010 Monroe ..... F41A 5/26 89/193
8,231,474 B2 * 7/2012 Stethem ..... F41B 15/04 463/47.3
8,356,614 B2 * 1/2013 Forrester ..... A45B 3/14 135/66
8,363,376 B2 * 1/2013 Abatemarco ..... A45B 3/04 361/232
8,424,350 B2 * 4/2013 Bernatchez ..... A44B 15/00 70/456 R
9,022,255 B1 * 5/2015 Calvert ..... F41H 9/10 222/79
9,228,804 B2 * 1/2016 Syrengelas ..... F41C 7/02
9,423,208 B1 * 8/2016 Mahmalji ..... F41C 23/16
D786,383 S * 5/2017 Saadon ..... D22/108
D786,384 S * 5/2017 Saadon ..... D22/108
D790,650 S * 6/2017 Saadon ..... D22/108
D790,651 S * 6/2017 Saadon ..... D22/108
D790,652 S * 6/2017 Gaddini ..... D22/108
9,696,111 B2 * 7/2017 Saadon ..... F41G 11/003
9,797,688 B2 * 10/2017 Kennair, Jr. ..... F41G 11/003
9,841,022 B2 * 12/2017 Jackson ..... F01C 1/18
2003/0056776 A1 * 3/2003 Doud ..... F41B 7/003 124/27
2005/0028801 A1 * 2/2005 Lewis ..... F41B 11/50 124/45
2005/0188827 A1 * 9/2005 McNulty, Jr. ..... F41B 15/04 89/1.11
2006/0120009 A1 * 6/2006 Chudy, II ..... F41H 13/0025 361/232
2007/0194048 A1 * 8/2007 Teig ..... F21V 33/0076 222/113
2007/0295319 A1 * 12/2007 Carter ..... F41A 9/83 124/49
2010/0224056 A1 * 9/2010 Monroe ..... F41A 3/62 89/193
2010/0229448 A1 * 9/2010 Houde-Walter ..... F41C 23/16 42/72
2011/0047851 A1 * 3/2011 Mock ..... F41C 23/16 42/72
2011/0210146 A1 * 9/2011 Dapper ..... F41H 9/10 222/113
2011/0265366 A1 * 11/2011 Hinds, Jr. ..... F41A 23/08 42/94
2012/0272557 A1 * 11/2012 Yan ..... F41C 23/12 42/69.01
2013/0333263 A1 * 12/2013 Hovey ..... F41C 23/16 42/72
2014/0048561 A1 * 2/2014 Mangold ..... F41H 9/10 222/153.11
2014/0182182 A1 * 7/2014 Adcock, Jr. ..... A01G 22/00 42/72
2014/0215887 A1 * 8/2014 Luckey ..... F41G 11/003 42/90
2014/0252028 A1 * 9/2014 Lord ..... F41H 9/10 222/79
2014/0360079 A1 * 12/2014 Iannello ..... F41G 11/003 42/90
2015/0083749 A1 * 3/2015 Ben Yair ..... F41H 9/10 222/79
2015/0121737 A1 * 5/2015 Anderson ..... F41C 23/16 42/72
2015/0300775 A1 * 10/2015 Combs ..... F41C 23/16 42/72
2015/0312399 A1 * 10/2015 Teig ..... H04W 4/90 455/404.2

* cited by examiner

WEAPONS SYSTEM FOREGRIP WITH INTEGRATED DEPLOYABLE COMPARTMENT FOR COMPLIANCE DEVICE

CROSS-REFERENCE TO RELATED APPLICATION

This application claims the benefit of U.S. Provisional Application No. 62/237,640, filed Oct. 6, 2015, the disclosure of which is hereby incorporated by reference.

FILED OF THE INVENTION

The present invention relates to accessories for firearms as well as to nonlethal weapons, More specifically, a foregrip for a firearm that is capable of holding a nonlethal compliance device therewithin is provided.

BACKGROUND OF THE INVENTION

The present invention is in the technical field of weapons accessories, vertical foregrip. More particularly, the present invention is in the technical field of non-lethal functionality expansion for firearms.

Conventional application of non-lethal compliance devices such as but not limited to dispersing canisters requires one hand operation. The time needed to extract such a device from the carry case or holster makes this option impractical in a hostile environment as it would put the weapon holding user at risk during operations needed to deploy such a device. Major difficulties are: main weapon may require both hands to operate, and to keep muzzle control; non-lethal canisters are kept separately from the main weapon leading to need of abandoning full control of the main weapon; intentions of using non-lethal options made obvious for the aggressor giving him/her opportunity to press an advantage. The aforementioned issues leave the user no choice but use of lethal force to demand compliance.

BACKGROUND ART

Integrated Spray devices have attempted to provide additional non-lethal force to a weapons system.

An example of a presently available device is disclosed by U.S. Pat. No. 9,170,073 B2, which was issued to Mangold, This is a slide activated device fitted to a rifle or Picatinny rail. A lock and spring is utilized when activated by movement toward the real. The use of a slide activated device teaches away the inventive features of the current invention.

U.S. Pat. No. 7,644,839 B2 McNulty, Jr. A container or housing mounted on a pistol, or other weapon, also for standalone use. A canister is installed and activated an irritant spray when a digit is pressed against the side of the storage cylinder. The housing holds a specific canister to the device. The use parallel to the barrel design teaches away from the inventive features of the current invention.

U.S. Pat. No. 6,658,779 B2, Bauer A weapon system with a firearm barrel that may propel a projectile and also non-lethal means ejecting a stream of fluid parallel to the barrel. The system houses a pressurized canister with a nozzle for the release of a fluid. The canister, nozzle and trigger may be removable from firearm. The horizontal design teaches away from the inventive features from current invention.

U.S. Pat. No. 5,983,548, Lidaescher, A combination lethal/non-lethal firearm device is disclosed wherein a lethal gun, pistol or rifle that conventionally fires solid projectiles in the form of bullets, is converted to a non-lethal defensive by canister unit attachment, activated by pressing a force application pad near the trigger guard. Lack of ergonomic features and lack cross platform compatibility teaches away from the inventive features from current invention.

U.S. Pat. No. 5,787,628, Teetzel, apparatus fitted to handguns and rifles. The apparatus utilizes a chassis containing a chemical module that houses MACE or other chemical.

Conventional handgun grips are replaced with electronic controls, switches and a power source. The apparatus can also be activated at a distance from the firearm using an infrared activation control. Orientation of the device and the operational controls teaches away from the inventive features from current invention.

SUMMARY OF THE INVENTION

The present invention is a Weapons System Foregrip with Integrated Deployable Compartment for Compliance Device that puts non-lethal devices such as dispersing canisters for pepper or other chemical spray irritants directly on the weapon inside of the conventional vertical or angular stabilizer grip, giving easy deployable option for the user between main (lethal) and axillary (non-lethal) devices without taking hands off the weapon and retaining muzzle control and target acquisition.

DETAILED DESCRIPTION OF THE INVENTION

Figure 1:
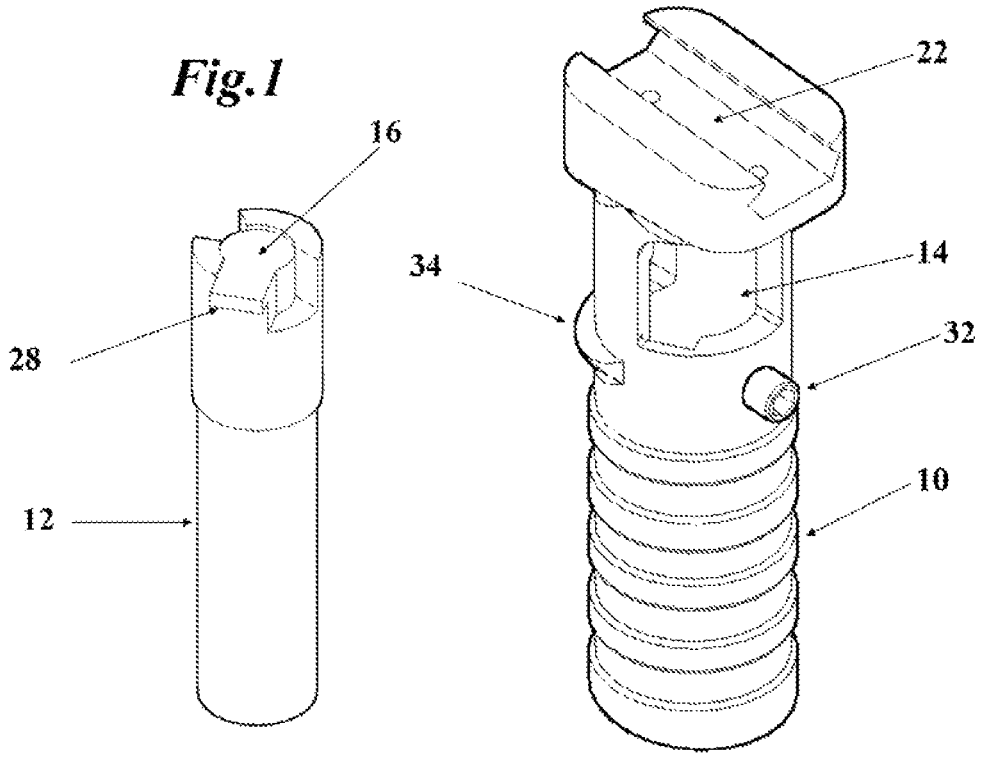
FIG. 1 is a perspective rear view of the foregrip with an example of compatible non-lethal device of the present invention.
Figure 2:
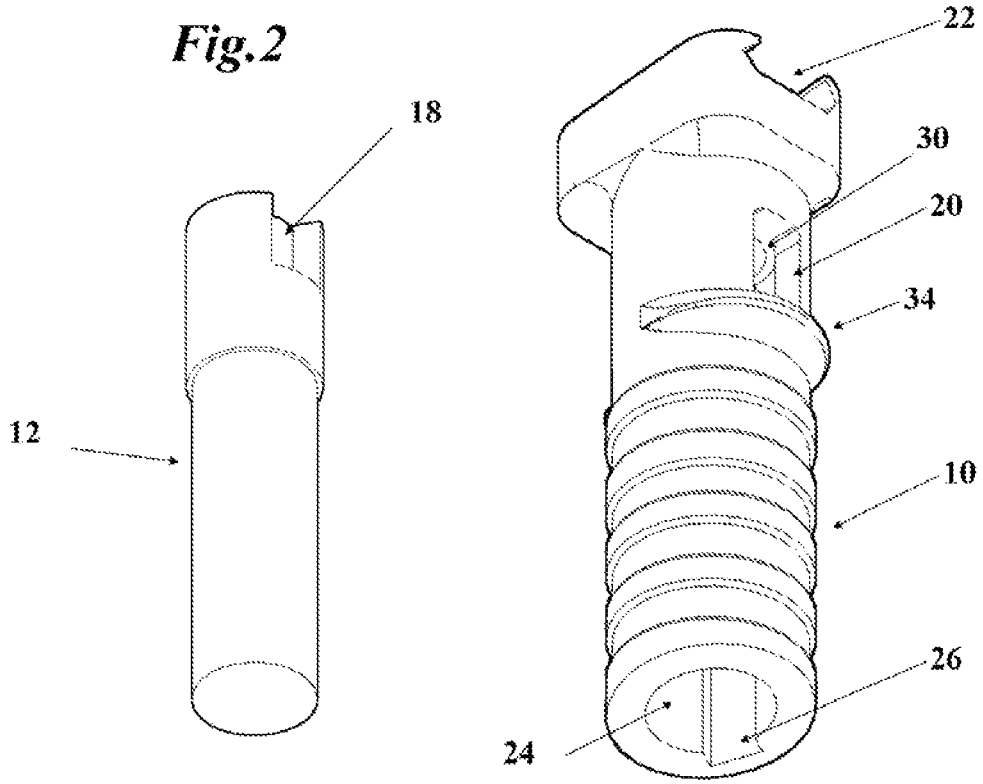
FIG. 2 is a perspective front view of a foregrip with an example of compatible non-lethal device of the present invention.

Referring to the invention in more detail, in FIG. 1 there is a foregrip (10) with an example of perspectively oriented tab actuated spray canister (12) to be loaded inside of the foregrip (10) with deployment controls opening (14) for the Deployment controls (16) of the tab actuated spray canister (12). FIG. 2 shows the invention from front view (10) with an example of perspectively oriented tab actuated spray canister (12). Once inserted, the muzzle of the tab actuated spray canister (18) is to be aligned with discharge window (20) on the foregrip (10). The foregrip (10) features a variety of conventional female geometry interfaces (22) compatible with picatinny rail or other functional systems where discharge window (20) is aligned with weapon system mounting rail. To load/unload the tab actuated spray canister (12), the foregrip (10) features a loading cavity (24) on the bottom of the foregrip with a clearance (26) for the activation tab (28 on FIG. 1) on the tab actuated spray canister (12). Stopper ring (30) prevents tab actuated spray canister (12) from going too far into the foregrip (10). To hold tab actuated spray canister (12) inside of the foregrip (10), a retention screw (32 FIG. 1) or other retention mechanism is used. The tactile discharge window clearance barrier (34) provides tactile feedback to prevent the hand from accidentally covering the discharge window (20) while tab actuated spray canister (12) is deployed.

In more detail, the tab actuated spray canister (12) can be loaded inside of the weapon system mounted (22) foregrip (10) using opening (24). Once loaded, the muzzle (18) of the compliance device (12) can be aligned with the muzzle opening discharge window (20) and locked using retention a screw (32) or other retention mechanism. The deployment controls opening (14) provides access to deployment controls (16) on the tab actuated spray canister (12) enabling activation of the tab actuated spray canister inside of the foregrip.

Figure 3:
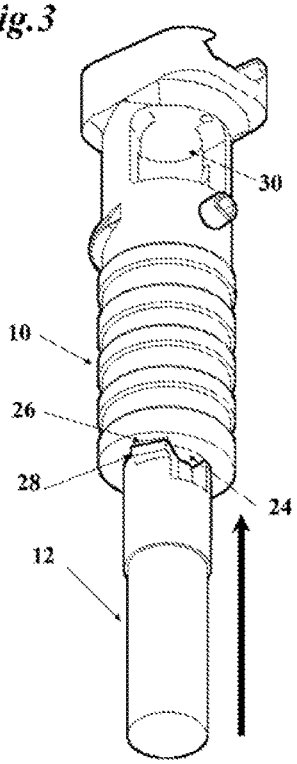
FIG. 3 is a perspective rear view of the foregrip of FIG. 1, showing a non-lethal device being inserted therewithin.
Figure 4:
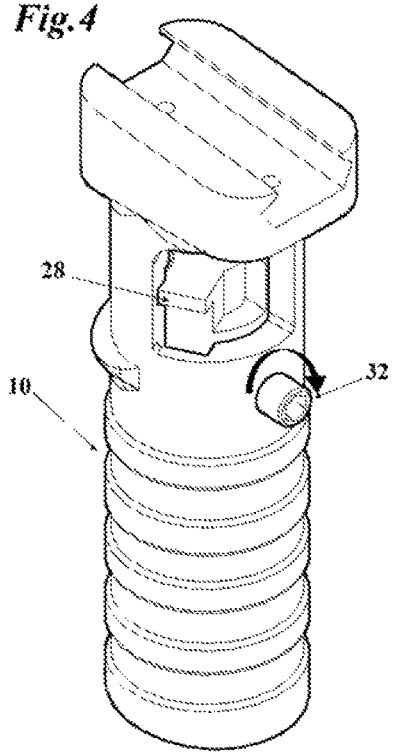
FIG. 4 is a perspective rear view of the foregrip of FIG. 1, illustrating an example means of retaining the canister inside of the present invention.
Figure 5:
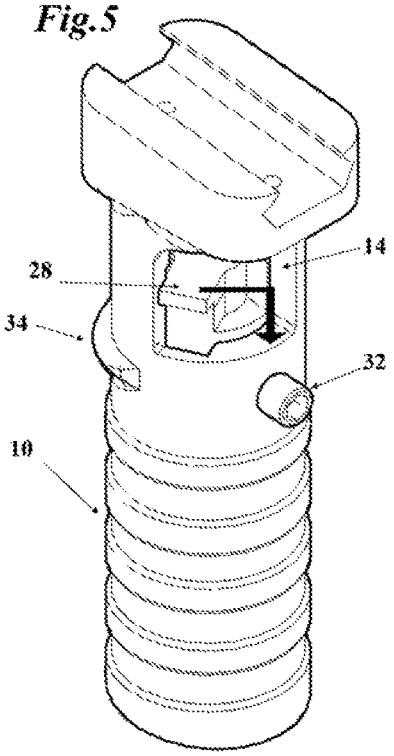
FIG. 5 is a rear perspective view of the foregrip pf FIG. 1, illustrating actuation of the loaded spray canister inside of the present invention.

Furthermore, the operation of the device is a sequence of the following actions: FIG. 3 align canisters activation tab (28) with activation tab clearance (26) in the loading cavity (24) of the said device (10) and push canister (12) inside of the said device (10) reaching stopper ring (30). FIG. 4 tightens the screw (32) to lock the canister (12) inside of the said device (10). FIG. 5 To activate spray device, lower the hand grip below the barrier (34) to clear the discharge window (20 FIG. 2), reach the activation tap (28) inside of the opening for the deployment controls (14), turn activation tab (28) to active position and press down to activate the spray canister.

The weapon system mounted (22) foregrip (10) functions as a standard vertical or angular stabilizing foregrip proportioned for intended functionality.

The construction details of the invention as shown in FIG. 1 through FIG. 5 are that the foregrip (10) may be made of metal or plastics or of any other sufficiently rigid and strong material. The various components of the foregrip (10) can be made of different materials as well.

The advantages of the present invention include, without limitation, the constant presence of the non-lethal compliance device on the main weapon aligned with the weapon muzzle with ability to deploy non-lethal compliance device retaining muzzle control and target acquisition. The present invention gives access to the alternative compliance action without taking hands off the main weapon. Furthermore, the present invention allows access to all of the functions for safety and activation of the tab actuated spray canister. The present invention expands functionality of a conventional vertical or angular stabilizing foregrip and can be used as such without limitation.

While the foregoing written description of the invention simplistically describes a base use the existence of variations, combinations, and equivalents of the specific embodiment, method, and examples herein are endless. The invention should therefore not be limited by the above described embodiment, method, and examples, but by all embodiments and methods within the scope and spirit of the invention as claimed.

The invention claimed is:

1. A combination of a grip for a firearm and a compliance device, comprising:

a compliance device, comprising a spray canister having deployment controls movably secured to the spray canister, the deployment controls including a muzzle and an activation tab, the deployment controls of the spray canister being rotatable between a safe position wherein depression of the activation tab is resisted and an active position wherein depression of the activation tab is permitted;

a grip, comprising:

a handle portion, the handle portion defining a bottom and a top opposite the bottom, the handle portion further defining an external gripping surface and an internal cavity, the cavity being structured to retain the spray canister therein, the bottom defining an opening, the opening being dimensioned and configured to permit passage of the spray canister therethrough, the handle portion further defining a control opening that is positioned for alignment with the activation tab, the grip further defining a discharge window that is positioned for alignment with the muzzle;

a releasable retention device that is structured to releasable retain the spray canister within the cavity, the releasable retention device being a screw disposed within a threaded hole defined within the handle portion, whereby tightening the screw causes the screw to abut the canister and to resist removal of the spray canister from the cavity, and loosening the screw permits removal of the spray canister from the cavity; and an attachment device attached to the top of the handle portion, the attachment device being structured to secure the grip to a firearm.

2. The combination according to claim 1, wherein the attachment device is an interface for an accessory mounting rail forming a portion of the firearm.

3. A spray canister grip for a firearm, the spray canister having deployment controls movably secured to the spray canister, the deployment controls including a muzzle and an activation tab, the spray canister grip comprising:

a handle portion, the handle portion defining a bottom and a top opposite the bottom, the handle portion further defining an external gripping surface and an internal cavity, the cavity being structured to retain the spray canister therein, the bottom defining an opening, the opening being dimensioned and configured to permit passage of the spray canister therethrough, the internal cavity further including a clearance, the clearance being structured to permit passage of the activation tab therethrough, the handle portion further defining a control opening that is positioned for alignment with the activation tab, the grip further defining a discharge window that is positioned for alignment with the muzzle, the handle portion further having a barrier extending outward from the handle portion below the discharge window;

a releasable retention device that is structured to releasably retain the spray canister within the cavity, the releasable retention device being a screw disposed within a threaded hole defined within the handle portion, whereby tightening the screw causes the screw to abut the canister and to resist removal of the spray canister from the cavity, and loosening the screw permits removal of the spray canister from the cavity; and an attachment device attached to the top of the handle portion, the attachment device being structured to secure the grip to a firearm.

4. The spray canister grip according to claim 3, wherein the attachment device is an interface for an accessory mounting rail forming a portion of the firearm.

5. The combination according to claim 1, wherein:

the internal cavity of the handle portion further includes a clearance, the clearance being structured to permit passage of the activation tab therethrough; and the handle portion includes a barrier extending outward from the handle portion below the discharge window.

* * * * *